US008616594B2

(12) United States Patent
Shimura et al.

(10) Patent No.: US 8,616,594 B2
(45) Date of Patent: Dec. 31, 2013

(54) DEVICE FOR OPERATING A DOOR LATCH IN A VEHICLE

(75) Inventors: Ryoji Shimura, Yokohama (JP); Hirotaka Nishijima, Yokohama (JP); Hajime Yoneyama, Yokohama (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 341 days.

(21) Appl. No.: 12/835,267

(22) Filed: Jul. 13, 2010

(65) Prior Publication Data

US 2011/0012379 A1 Jan. 20, 2011

(30) Foreign Application Priority Data

Jul. 16, 2009 (JP) ..... 2009-167456

(51) Int. Cl.
*E05B 3/00* (2006.01)
*E05C 19/00* (2006.01)
*E05C 3/06* (2006.01)

(52) U.S. Cl.
USPC ..... 292/336.3; 292/1; 292/201

(58) Field of Classification Search
CPC ..... E05B 85/16; E05B 81/14; E05B 85/26
USPC ..... 292/336.6, DIG. 46, 1, 201, 216, 292/DIG. 23
See application file for complete search history.

(56) References Cited

U.S. PATENT DOCUMENTS 4,968,074 A * 11/1990 Yamagishi et al. ..... 292/201
5,618,068 A * 4/1997 Mitsui et al. ..... 292/201
5,893,593 A * 4/1999 Dowling ..... 292/336.3
6,135,513 A * 10/2000 Hamada et al. ..... 292/201
6,332,634 B1 * 12/2001 Fukumoto et al. ..... 292/201
6,561,557 B2 * 5/2003 Choi ..... 292/336.3
6,616,202 B2 * 9/2003 Choi ..... 292/336.3
6,722,714 B2 * 4/2004 Ooe et al. ..... 292/216
6,808,226 B2 * 10/2004 Hirano ..... 296/155
6,955,389 B2 * 10/2005 Suzuki et al. ..... 296/146.4
7,434,854 B2 * 10/2008 Fujimatsu et al. ..... 292/336.3
7,438,301 B2 * 10/2008 Schilling et al. ..... 280/79.7
7,438,331 B2 * 10/2008 Wakatsuki ..... 292/216
7,472,944 B2 * 1/2009 Miyagawa et al. ..... 296/155
7,488,014 B2 * 2/2009 Nozawa et al. ..... 292/216
7,540,541 B2 * 6/2009 Yoneyama et al. ..... 292/216
7,591,493 B2 * 9/2009 Nozawa ..... 292/216
8,061,742 B2 * 11/2011 Machida et al. ..... 292/201
2004/0004357 A1 * 1/2004 Arlt et al. ..... 292/201
2005/0121920 A1 * 6/2005 Machida ..... 292/201
2005/0167991 A1 * 8/2005 Yoneyama ..... 292/201
2006/0125244 A1 * 6/2006 Mochizuki et al. ..... 292/201
2008/0105011 A1 * 5/2008 Machida et al. ..... 70/237

FOREIGN PATENT DOCUMENTS

JP 2006-152619 A 6/2006

* cited by examiner

*Primary Examiner* — Carlos Lugo
*Assistant Examiner* — Nathan Cumar
(74) *Attorney, Agent, or Firm* — Sughrue Mion, PLLC

(57) ABSTRACT

An action with a handle on a vehicle is transmitted to an operational unit in a door, and then to a locking-unlocking unit via a first action-transmitting member. The locking-unlocking unit allows the door latch to disengage from a striker of the vehicle via a second action-transmitting member. The door of the vehicle opens.

8 Claims, 14 Drawing Sheets

DEVICE FOR OPERATING A DOOR LATCH IN A VEHICLE

BACKGROUND OF THE INVENTION

The present invention relates to a device for operating a door latch in a vehicle in which an action with a handle can be transmitted to a door latch.

An operating device of a vehicle door latch comprises an input portion such as a door lever 110 into which an action with a handle is transmitted; a releasing portion such as an opening lever 140 and a subsidiary opening lever 150 for transmitting action of a door latch; and a locking-unlocking mechanism such as a locking lever 180 or a locking actuator 190 for validating and invalidating action of the handle, arranged in parallel longitudinally on a base member fixed to the door in JP2006-152619A.

However, in the operating device for a vehicle door latch, the input portion cancelling portion and locking portion are arranged in parallel on the single base member to increase the size along the length of the vehicle and to contact a fixing portion of an armrest provided on a door trim, providing unsuitable arrangement in a door.

SUMMARY OF THE INVENTION

In view of the disadvantages, it is an object of the invention to provide a device for operating a door latch in a vehicle, achieving suitable arrangement in a door.

DETAILED DESCRIPTION OF PREFERRED EMBODIMENTS

Figure 1:
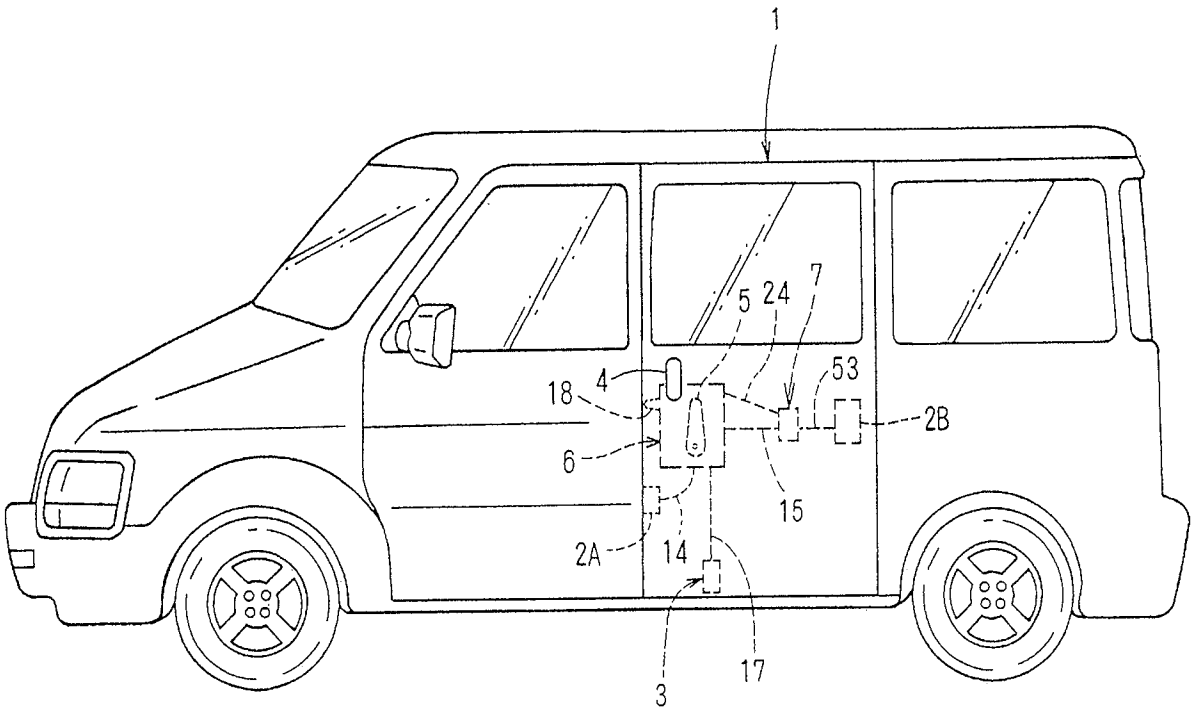
FIG. 1 is a side elevational view of a vehicle having a sliding door to which the present invention is applied.

In FIG. 1, a sliding door 1 opens and closes longitudinally at the side of a vehicle. At the front and rear ends of the sliding door 1, a fully-closing front door latch 2A and a fully-closing rear door latch 2B engage with front and rear strikers (not shown) of a vehicle body to keep the door 1 in a closed position and disengage from the front and rear strikers to enable the door 1 to open. At the lower end of the door 1, a fully-opening door latch 3 engages with a striker (not shown) of the vehicle body to keep the door 1 in a fully-open position.

On an outer panel of the door 1, an outside handle 4 is provided to open and close the door 1 from outside the vehicle, while an inside handle 5 is provided to open and close the door 1 from inside the vehicle. In an inner panel of the door 1, there are an operational unit 6 comprising levers operated by the outside handle 4 and the inside handle 5; and a locking-unlocking unit 7 behind the operational unit 6 spaced in parallel with the inner panel of the door 1 behind the operational unit 6. The operational unit 6 and the locking-unlocking unit 7 are disposed in a space between the interior surface of the inner panel and a door trim (not shown) mounted onto the interior of the inner panel.

In this embodiment, the locking-unlocking unit 7 is disposed behind the operational unit 6. The position of the locking-unlocking unit 7 is determined by the shape of the door 1, a position of the operational unit 6, a position of the fully-closing rear door latch 2B, etc. As well as behind the operational unit 6, the locking-unlocking unit 7 may be disposed at other position spaced from the operational unit 6 in parallel with the surface of the inner panel of the door 1.

The Structure of the Operational Unit 6

As shown in FIGS. 2-7, the operational unit 6 comprises a base member 8 and a cover 19 fixed to the inner panel of the door 1; a handle-base member 9 fixed to the surface of the handle-base member 9 facing the interior of the vehicle; the inside handle 5 pivotally mounted to the handle-base member 9 to swing back and forth; first and second inside input levers 10,11 inputting the action of the inside handle 5; an outside input lever 12 inputting the action of the outside handle 4; a fully-closing output lever 13 to enable releasing action of the first and second inside input levers 10,11 and outside input lever 12 to be transmitted to a fully-closing front door latch 2A and locking-unlocking unit 7; a fully-opening output lever 16 to enable releasing of the first and second inside input levers 10,11 and the outside input lever 12 to be supplied to the fully-opening door latch 3; and a childproof lever 18 operable to an unlocking position and a locking position later described only when the door 1 is open.

The operating base member in this embodiment comprises a base member 8 and a cover 19, but the present invention is not limited to the embodiment. The operating base member may comprise a base member 8 or a cover 19. In the embodiment, the first inside input lever 10 and the second inside input lever 11 are separately formed, but the present invention is not limited thereto. The first inside input lever 10 and the second inside input lever 11 may be integrally formed.

The inside handle 5 is pivotally mounted to the handle base member 9 fixed to the side facing the inside of the base member 8 about a vertical pivot to swing longitudinally to enable "opening action" from a neutral position rearward or in a door-opening direction and "closing action" from a neutral position forward or in a door-closing direction. At the lower part of the inside handle 5, there is an arm 5*a* extending outward to be capable of moving longitudinally with the inside handle 5.

Figure 2:
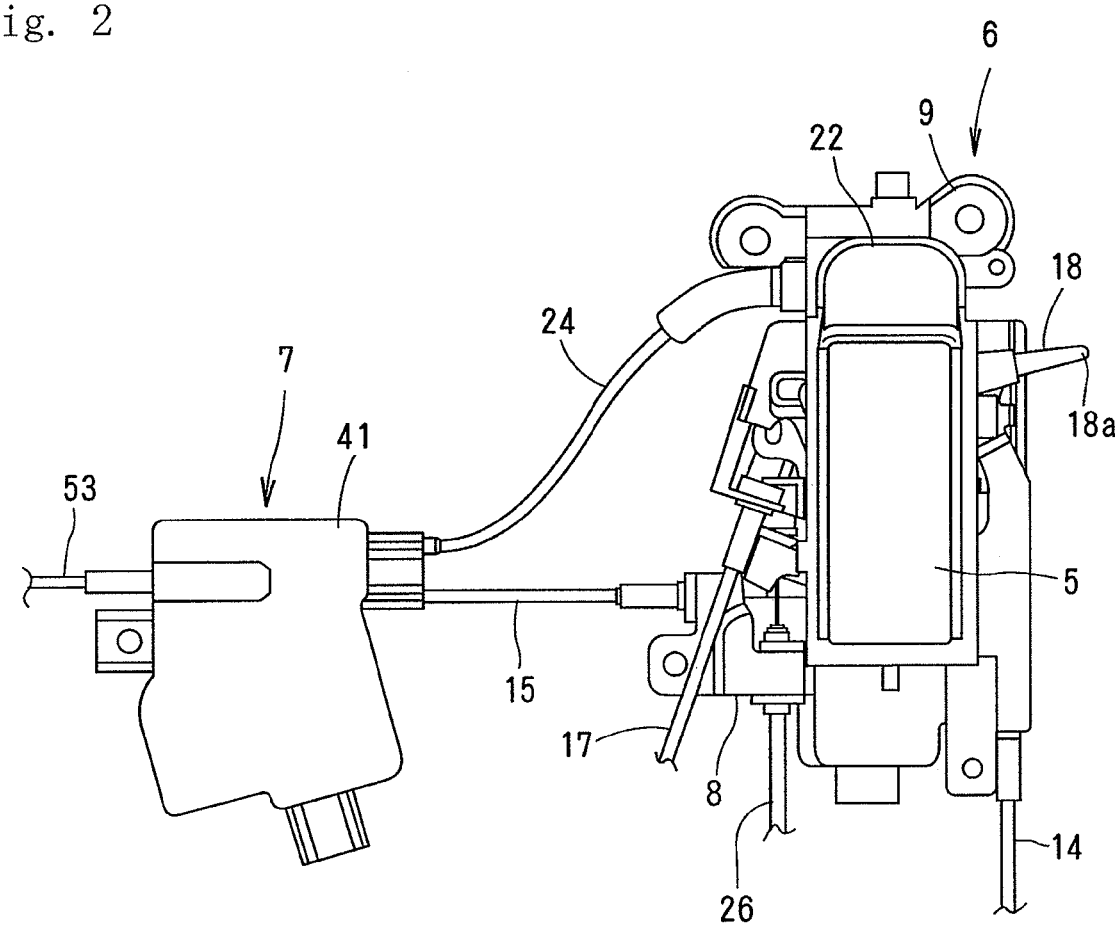
FIG. 2 is a front elevational view of a device for operating a door in a vehicle according to the present invention.
Figure 3:
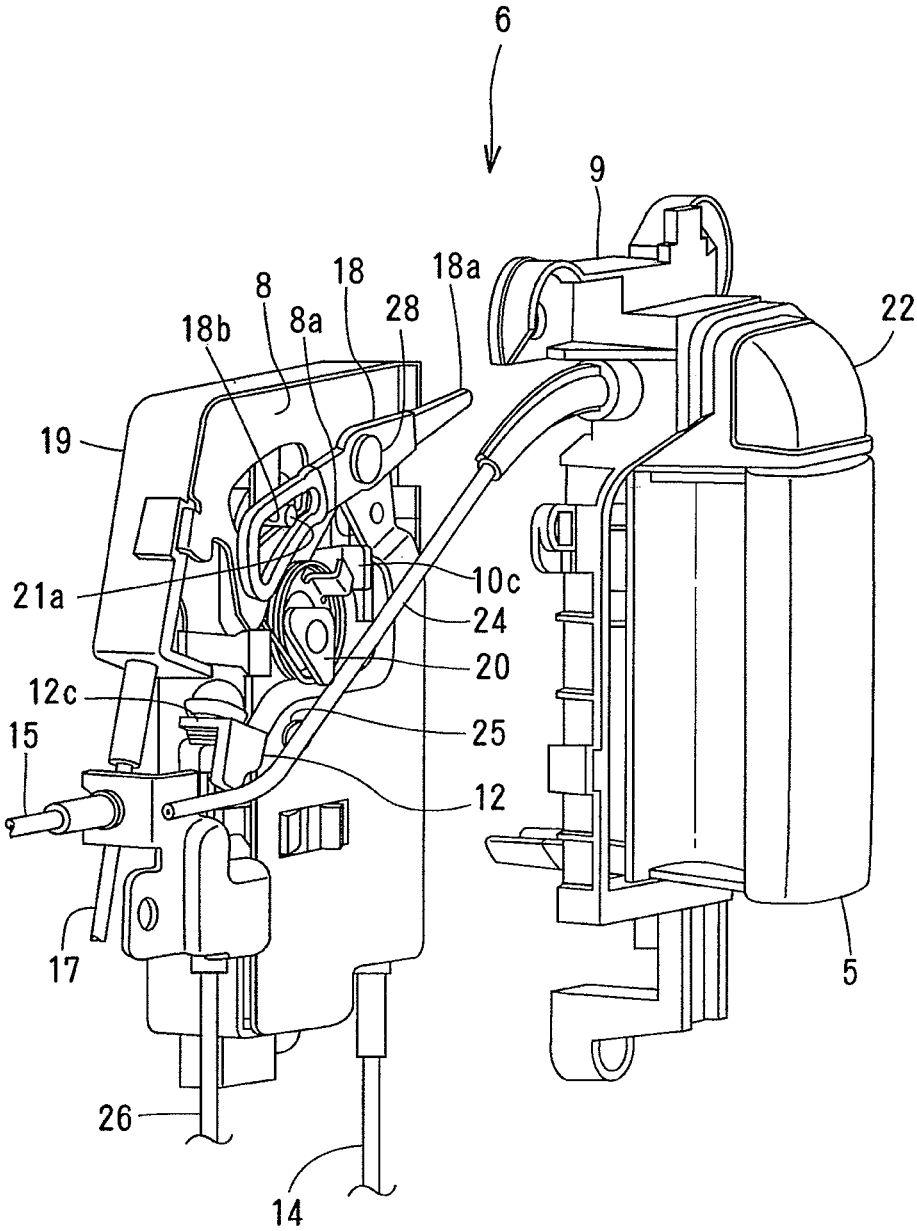
FIG. 3 is an exploded perspective view of an operational unit and an inside handle seen from inside a vehicle.
Figure 4:
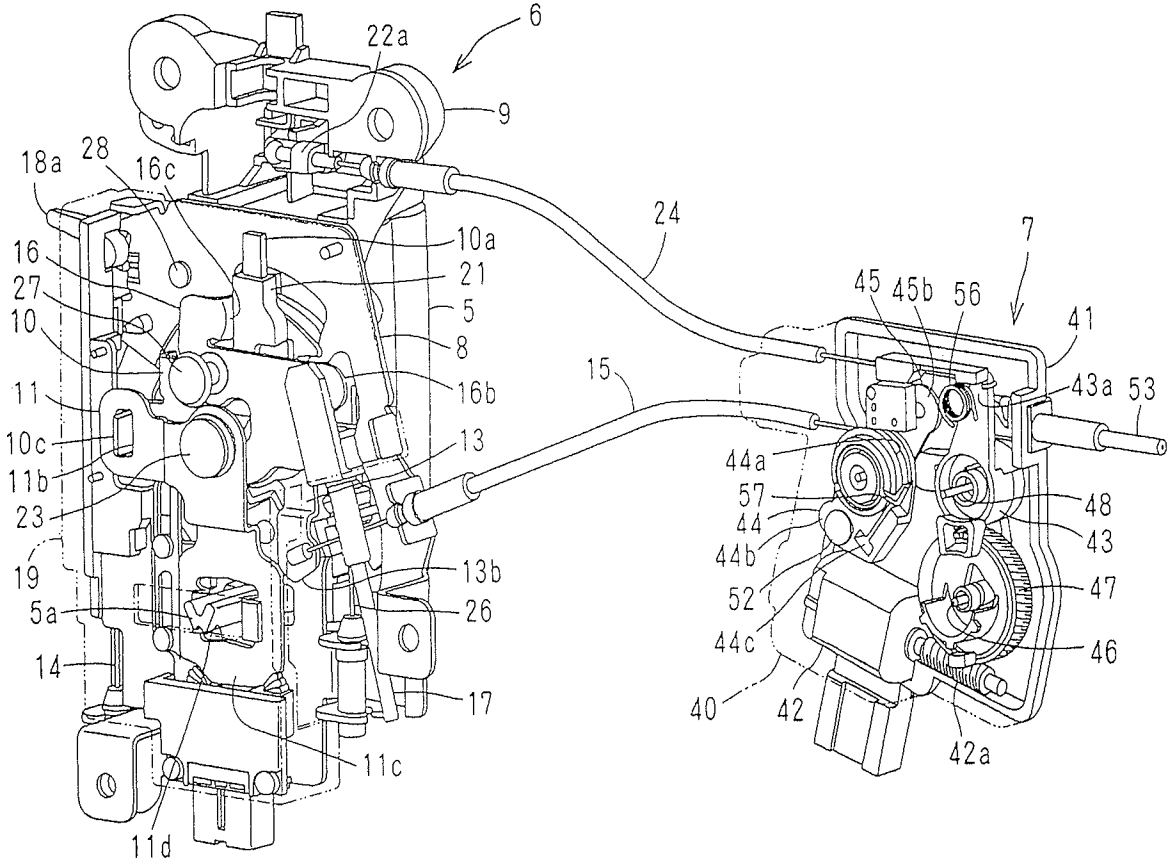
FIG. 4 is a perspective view of the internal structure seen from outside the vehicle.

Above the inside handle 5 of the handle-base member 9, a locking knob 22 is operable for unlocking and locking from inside the vehicle. The locking knob 22 is movable between an unlocking position in FIGS. 2 and 3 for validating the opening action of the inside handle 5 and the action of the outside handle 4 and a locking position which moves forward from the unlocking position to invalidate the action of the outside handle 4. To a connecting portion 22*a* passing through the handle-base member 9 of the locking knob 22, a locking lever 43 (later described) of the locking-unlocking unit 7 is connected via a Bowden cable 24 which is an action-transmitting long member. In FIG. 2, rotary shafts 20, 23, 25, 27, 28 are disposed within a projecting area of the handle-base member 9 thereby making the operational unit 6 smaller.

The first inside input lever 10 is pivotally mounted to the base member 8 to rotate with the rotary shaft 20 extending transversely, and comprises a linear upward arm 10*a* allowing a slider 21 (later described) to move vertically; an outside-directing bent portion 10*b* contacting upper and lower ends of an opening 8*a* of the base member 8 to limit a rotation range of the first inside input lever 10; and an outside-directing bent portion 10*c* which engages in an engagement hole 11*b* of the second inside input lever 11.

To the cover 19, the second inside input lever 11 is pivotally mounted on a pivot shaft 23 facing the rotary shaft 20 and disposed transversely about substantially the same axis as the rotary shaft 20. The forward-extending arm 11*a* has an engagement hole 11*b* in which the bent portion 10*c* of the first inside input lever 10 fits such that the first inside input lever 10 and the second inside input lever 11 rotate together. The lower part of a downward-extending arm 11*c* has an engagement hole 11*d* in which the arm 5*a* of the inside handle 5 engages with play. Thus, the first and second inside input levers 10,11 rotate clockwise or in a fully-closing release direction at a predetermined angle from the neutral position in FIGS. 6 and 8 by the opening action of the inside handle 5 and counter-clockwise from the neutral position or fully-opening release direction by the closing action of the inside handle 5.

An arm 11*c* of the second inside input lever 11 is corresponding to the operational portion inside the vehicle coupled to the handle inside the vehicle according to the present invention. A direction and shape of the arm 11*c* is variable if required.

Figure 14:
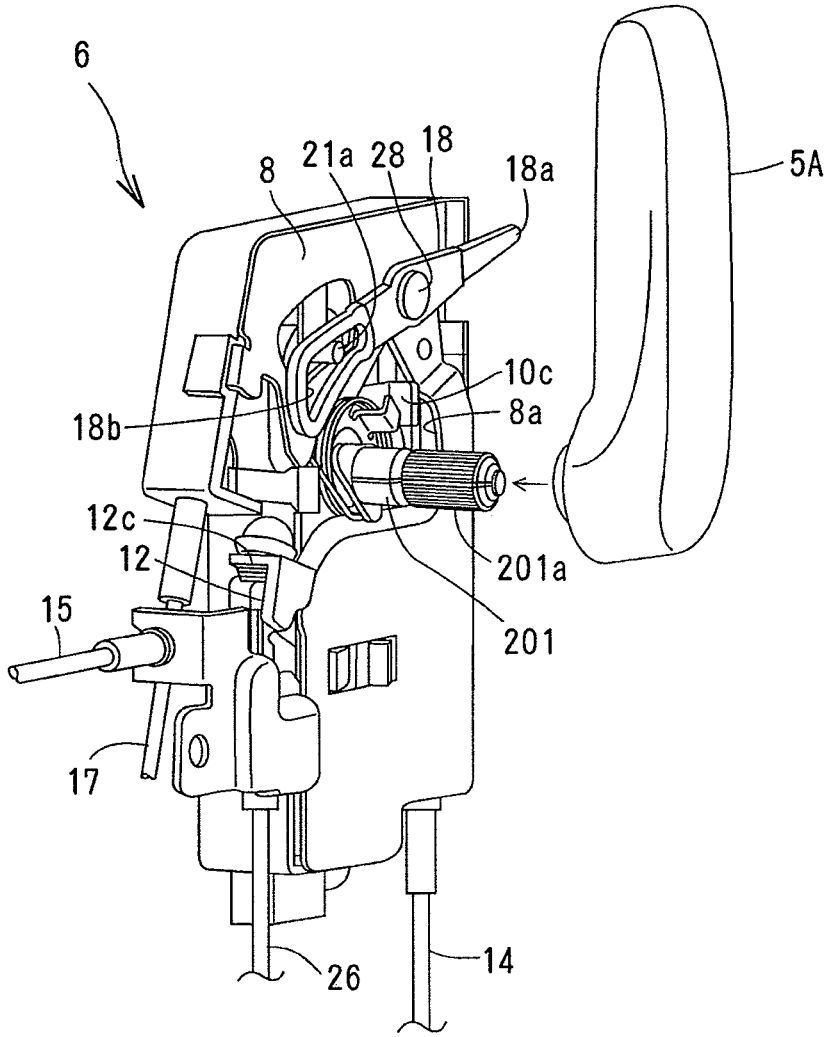
FIG. 14 is an exploded perspective view of the operational unit in which another embodiment of the inside handle is used.

Depending on the shape of the door 1 and type of the vehicle, the inside handle 5 can be easily changed from a T-sectioned type which swings longitudinally about a vertical axis in FIGS. 2, 3, 4 and 6 to a bar-like inside handle 5A swinging longitudinally about a horizontal axis in FIG. 14. When the bar-like inside handle 5A is used, the rotary shaft 20 is modified to a rotary shaft 201 having a serration 201*a* on part projecting from the base member 8 inside the vehicle in FIG. 14. The serration 201*a* is inserted and engaged in the inside handle 5A. Thus, without changing other parts than the rotary shaft 20, the T-sectioned inside handle 5 can be easily changed to the bar-like inside handle 5A. When the bar-like inside handle 5A is used, the handle-base member 9 is not required.

Figure 6:
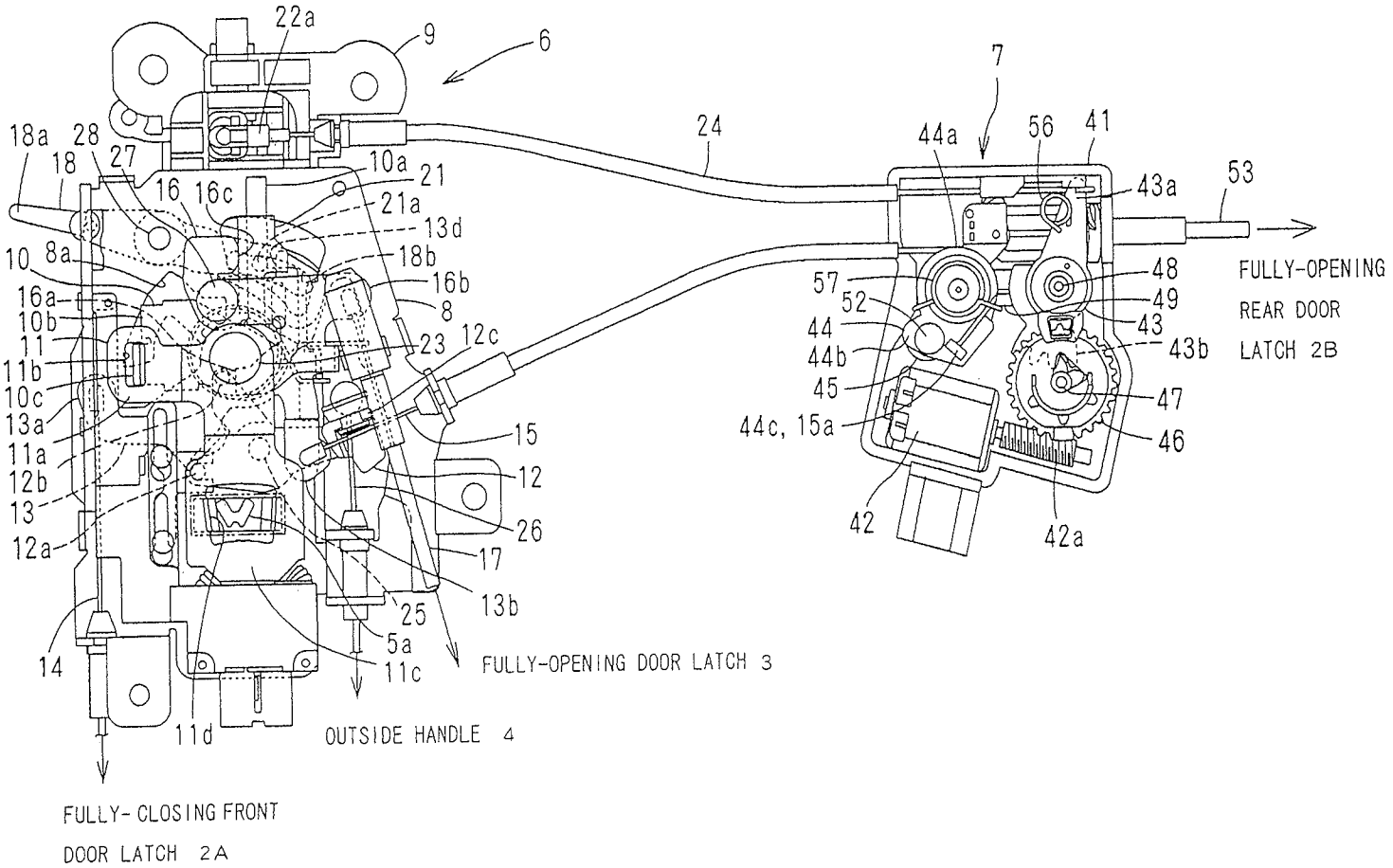
FIG. 6 is a rear view seen from outside the vehicle.
Figure 7:
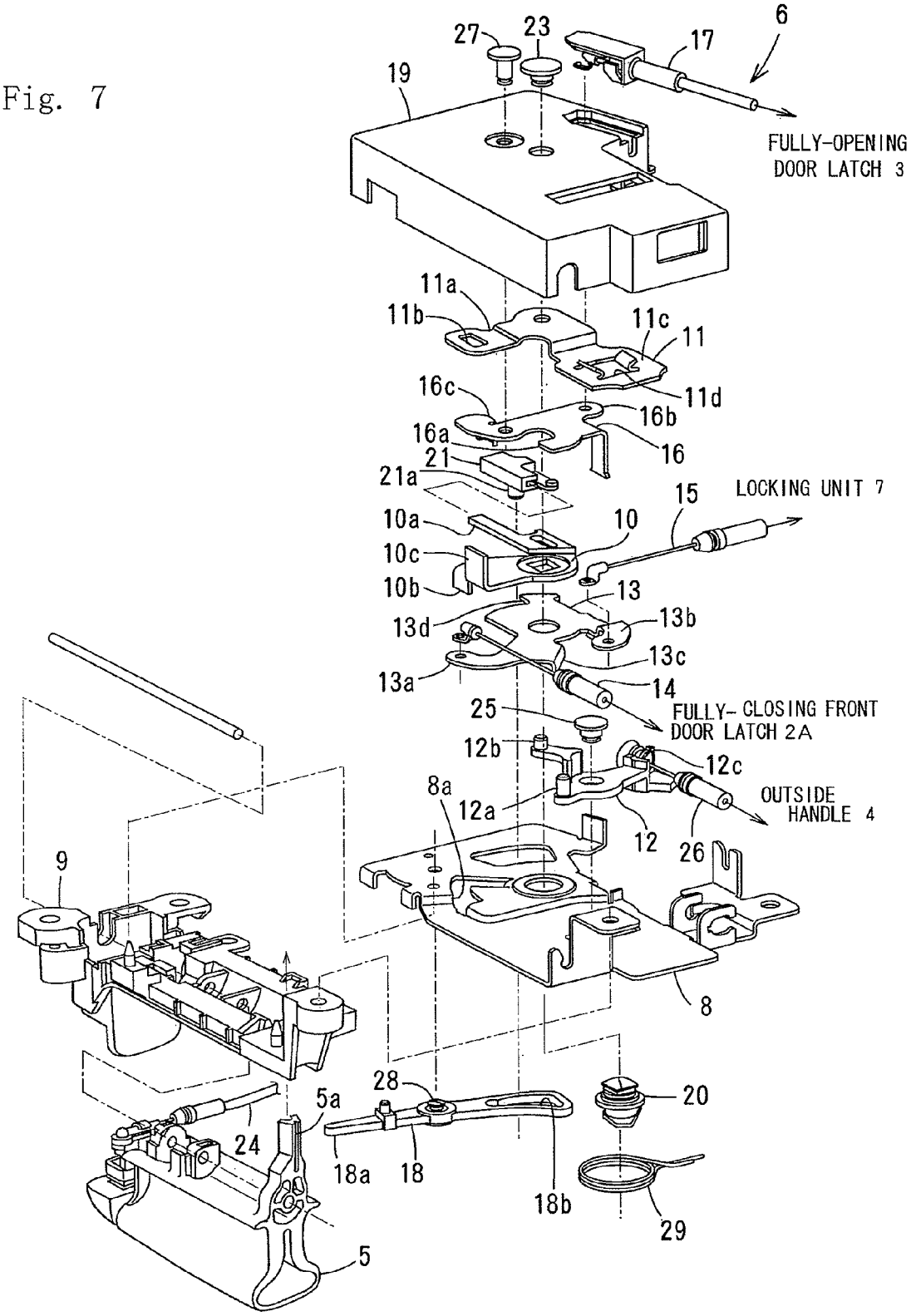
FIG. 7 is an exploded perspective view of an operational unit.
Figure 8:
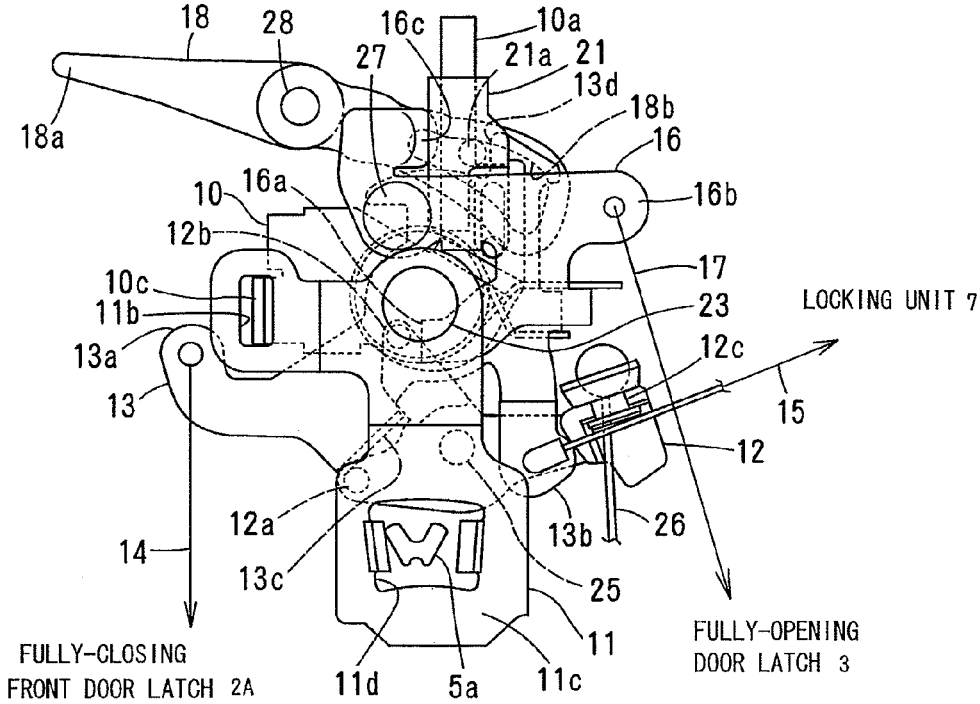
FIG. 8 is a rear view of the main part of the operational unit.
Figure 12:
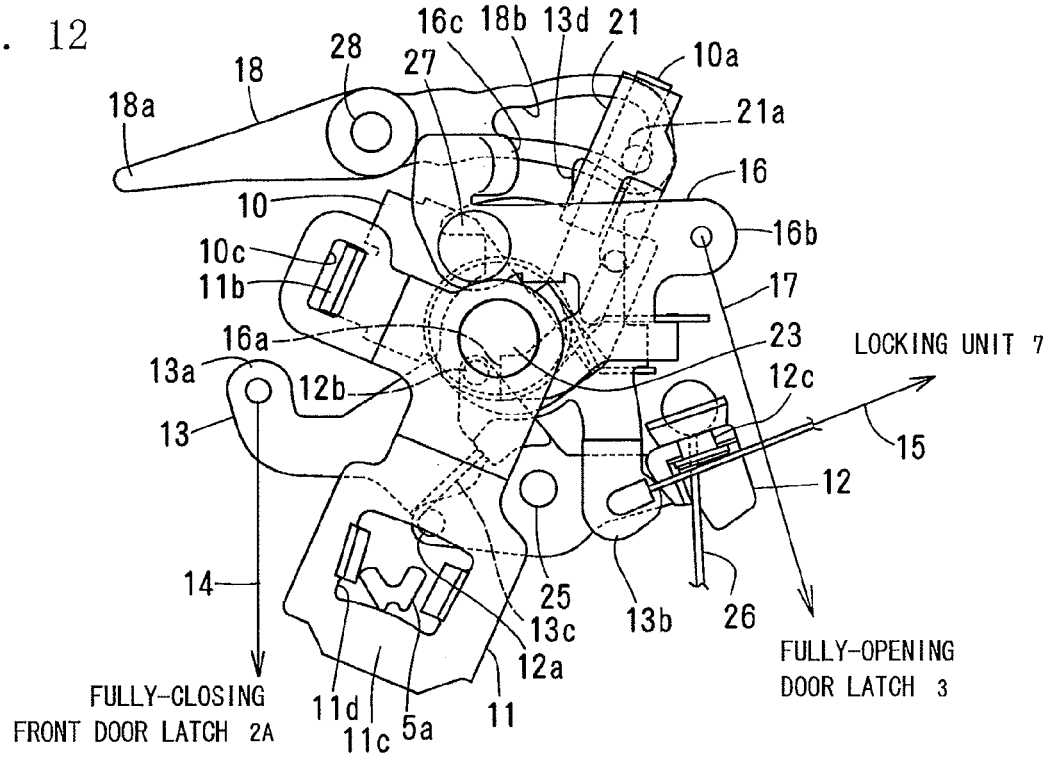
FIG. 12 is a view of the operational unit in which the inside handle is actuated when the childproof lever is in the locking position.
Figure 13:
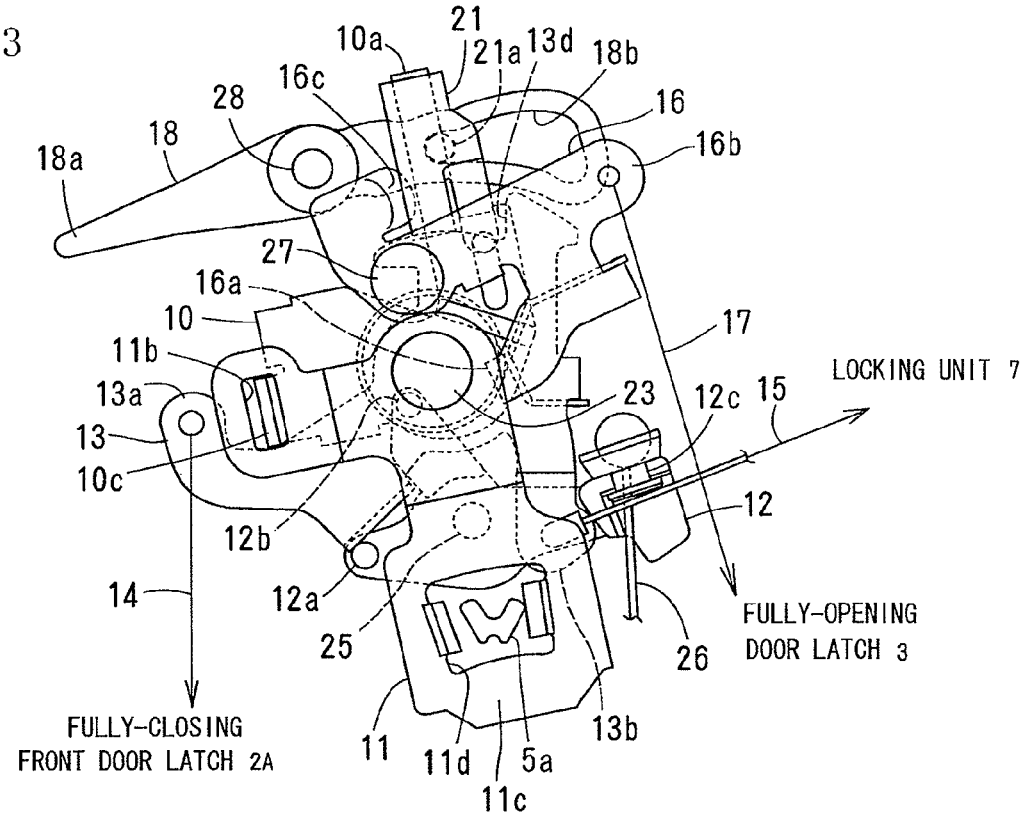
FIG. 13 is a view of the operational unit in which the inside handle is actuated when the childproof lever is in the locking position.

The childproof lever 18 is pivotally mounted on the pivot shaft 28 extending transversely, to the side of the base member 8 facing the inside of the vehicle and can move between the unlocking position in FIGS. 6 and 8 for validating opening action of the inside handle 5, and the locking position in FIGS. 12 and 13 for invalidating the opening action. At the front of the childproof lever 18, an operated portion 18*a* projects from the front end face of the door 1, and at the rear there is provided an arcuate hole 18*b* in which a projecting shaft 21*a* at the side of the slider 21 slides.

The slider 21 is in sliding contact with the arm 10*a* of the first inside input lever 10. The projecting shaft 21*a* slides in the arcuate hole 18*b* of the childproof lever 18. When the childproof lever 18 is in the unlocking position, the projecting shaft is held in the unlocking position under the arm 10*a* in FIGS. 6 and 8, and when the childproof lever 18 is moved into the locking position, it is moved from the unlocking position to the locking position in FIGS. 12 and 13.

In FIGS. 6 and 8, when the childproof lever 18 and the slider 21 are in the unlocking position, the projecting shaft 21*a* of the slider 21 becomes capable of contacting an engagement step 13*d* of the fully-closing output lever 13 clockwise. Thus, when the inside lever 5 is operated to open the door, the first and second inside input levers 10,11 rotates in a fully-closing releasing direction or clockwise in FIGS. 6 and 8, the projecting shaft 21*a* of the slider 21 moving with the first inside input lever 10 contacts the engagement step 13*d* of the fully-closing output lever 13, so that the fully-closing output lever 13 rotates with the first and second inside input levers 10,11 in the fully-closing releasing direction.

When the childproof lever 18 and the slider 21 are in the locking position in FIGS. 12 and 13, the projecting shaft 21*a* of the slider 21 does not contact the engagement step 13*d* of the fully-closing output lever 13 in an avoiding position. Therefore, even if the first and second inside input levers 10,11 rotate in the fully-closing releasing direction, the projecting shaft 21*a* of the slider 21 swings with respect to the engagement step 13*d* of the fully-closing output lever 13, so that the fully-closing output lever 13 cannot rotate in the releasing direction.

The fully-closing output lever 13 is pivotally mounted on a rotary shaft 20 to the base member 8 to rotate independently from the first inside input lever 10. To the end of a forward-extending arm 13*a*, the upper end of a Bowden cable 14 is coupled, and the lower end of the Bowden cable is connected to a release lever (not shown) of the fully-closing front door latch 2A. To the lower end of a downward-extending arm 13*b*, the front end of a Bowden cable 15 is coupled. The Bowden cable 15 as the first action-transmitting member is connected at the rear end to a locking-unlocking input member 44, later described, of the locking-unlocking unit 7 and is movable along the inner panel surface of the door 1 with releasing of the fully-closing output lever 13. Via the Bowden cable 14, releasing action with the fully-closing output lever 13 is transmitted to a release lever (not shown) of the fully-closing front door latch 2A, and via the Bowden cable 15 as the first action-transmitting member, releasing action of the fully-closing output lever 13 is transmitted to the locking-unlocking input member 44 of the locking-unlocking unit 7.

The arms 13*b*,13*c* of the fully-closing output lever 13 are corresponding to an action-outputting portion of a handle according to the present invention and may be changed or modified in a direction and shape. The arm 13*a* may be omitted depending on the shape of the door 1.

When the door 1 is held in the closed position, the fully-closing output lever 13 rotates from a standby position in FIGS. 6 and 8 in a releasing direction or clockwise. The releasing action by the fully-closing output lever 13 is transmitted to the fully-closing front door latch 2A via the Bowden cable 14 and to the locking-unlocking input member 44 of the locking-unlocking unit 7 via the Bowden cable 15. If the releasing action by the fully-closing output lever 13 is transmitted to each of the door latches 2A,2B, each of the door latches 2A,2B leave each of the strikers to allow the door 1 to open.

The fully-opening output lever 16 is pivotally mounted on a transverse pivot shaft 27 to the cover 19 and comprises in the upper part a contact portion 16*c* which contacts the arm 10*a* of the first inside input lever 10 when the first and second inside input lever 10,11 rotate in a fully-open releasing direction or counterclockwise in FIGS. 6 and 8 and in the lower part a contact portion 16*a* which contacts a projection 12*b* of the outside lever 12 when the outside lever 12 rotates in a releasing direction or clockwise in FIGS. 6 and 8. Furthermore, to an arm 16*b* which extends rearward of the fully-opening output lever 16, is coupled the upper end of a Bowden cable 17 which is coupled at the lower end to the fully-opening door latch 3 and is movable along the inner panel surface of the door 1. Thus, when the fully-opening door latch 3 engages with the striker to hold the door in a fully-open position, the first and second inside input levers 10,11 rotate in the fully-open releasing direction to allow the arm 10*a* of the first inside input lever 10 to contact the contact portion 16*c* of the fully-opening output lever 16 via the slider 21, so that the fully-opening output lever 16 rotates in a releasing direction or counterclockwise from the standby position in FIGS. 6 and 8. The releasing action by the fully-opening output lever 16 is transmitted to a release lever (not shown) of the fully-opening door latch 3 via the Bowden cable 17. So the fully-opening door latch 3 leaves the striker to allow the door to close.

The fully-closing output lever 13 and the fully-opening output lever 16 are pushed by the spring 29, and the first and second inside input levers 10,11 are held in a neutral position by the spring 29.

The arm 16*b* of the fully-opening output lever 16 is corresponding to another action output portion which is capable of outputting in a direction unlike the action output portion comprising the arm 13*b* of the fully-closing output lever 13 for the handle according to the present invention. The arm 16*b* is variable in direction and shape.

The outside input lever 12 is pivotally mounted on the transverse pivot shaft 25 to the base member 8. To the end of the arm 12*c* extending rearward, is coupled the other end of the Bowden cable 26 as the fourth action-transmitting member one end of which is coupled to the outside handle 4. The action by the outside handle 4 is sent to the outside input lever 12 via the Bowden cable 26, rotating the outside input lever 12 in a releasing direction or clockwise from the standby position in FIGS. 6 and 8. When the outside input lever 12 rotates in the releasing direction, the projection 12*a* at the front end of the outside input lever 12 contacts the contact portion 13*c* in the lower part of the fully-closing output lever 13 thereby rotating the fully-closing output lever 13 in a releasing direction. At the same time, the projection 12*b* at the upper end contacts the contact portion 16*a* to rotate the fully-opening output lever 16 in a releasing direction. Therefore, when the outside handle 4 is operated, the fully-closing output lever 13 and the fully-opening output lever 16 are released together.

The arm 12*c* of the outside input lever 12 is corresponding to an outside action-input portion according to the present invention. The arm 12*c* is variable in direction and shape, if necessary.

The Structure of the Locking-Unlocking Unit 7

FIGS. 15-19 are views showing operation in each state of the locking-unlocking unit 7. In FIGS. 15-19, a casing 40 for including each element is removed to clarify the internal structure of the locking-unlocking unit 7. The locking-unlocking unit 7 comprises a casing 40 as locking-unlocking base member fixed to the inner panel of the door 1; a cover 41 for closing an opening of the casing 40; a motor 42 as electric actuator between the casing 40 and the cover 41; a locking lever 43 movable between the unlocking position and the locking position; a locking-unlocking input member 44; a locking-unlocking output lever 45; a limiting lever 49 and a worm wheel 46.

In this embodiment, the electric actuator comprises the reversible motor 42, but may be a reciprocating solenoid. In this case, the worm wheel 46 may be omitted. If the motor 42 is used, locking-unlocking means according to the present invention comprises the motor 42, the worm wheel 46, the locking lever 43 and the limiting lever 49, and if the solenoid is used, the locking-unlocking means comprises the solenoid, the locking lever 43 and the limiting lever 49, but is not limited thereto. If the locking-unlocking means can be switched between an unlocking state where the action of the Bowden cable 15 transmitted from the locking-unlocking input member 44 can be sent from the locking-unlocking output lever 45 to the fully-closing rear door latch 2B and a locking state where it cannot be outputted.

The motor 42 is disposed in the lower part of the casing 40 and comprises an output shaft to which a worm 42*a* which meshes with the worm wheel 46 is fixed. The worm wheel 46 is pivotally mounted on a transverse pivot shaft 47 in the casing 40 and meshes with the worm 42*a* to rotate clockwise and counterclockwise with rotation of the motor 42.

The locking lever 43 is pivotally mounted with a transverse pivot shaft 48 to move longitudinally in the casing 40. To an arm 43*a* extending upward of the locking lever 43, is coupled the rear end of the Bowden cable 24 which is coupled at the rear end to the locking knob 22. In the lower part of the casing 40, is provided a sector gear 43*b* which meshes with a gear 46*a* about the center of the worm wheel 46. Unlocking and locking action of the locking knob 22 is transmitted to the locking lever 43 via the Bowden cable 24, so that the locking lever 43 rotates between the unlocking position in FIGS. 15 and 16 and the locking position in FIGS. 17 and 18. When a switch in the vehicle or a portable switch is operated, the motor 42 is rotated, which is transmitted to the locking lever 43 via the worm wheel 46, the gear 46*a* and the sector gear 43*b*. So the locking lever 43 rotates between the unlocking position and the locking position. The locking lever 43 is held in the unlocking position and the locking position by a force of the turnover spring 56 fixed at one end to the locking lever 43 and at the other end to the casing 40 to vary a forcing direction.

A limiting lever 49 which has a stopper 49*a* at the front end is pivotally mounted on the same axis as the locking lever 43. The limiting lever 49 is forced clockwise anytime by a spring 50 fixed at one end to the locking lever 43 and at the other end to the limiting lever 49. The limiting lever 49 is usually held at a position where the limiting lever 49 contacts a contact portion 43 of the locking lever 43 and is rotatable with the locking lever 43 between the unlocking position in FIGS. 15 and 16 and the locking position in FIGS. 17 and 18. When the locking lever 43 is in the locking position, the limiting lever 49 can rotate against the force of the spring 50 counterclockwise with respect to the locking lever 43 if the action of the outside handle 4 or opening action of the inside handle 5 overlaps with unlocking action for moving the locking lever 43 from the locking position to the unlocking position in panic.

When the limiting lever 49 is held with the locking lever 43 in the unlocking position, the limiting lever 49 gets straight forward to allow the stopper 49*a* to come in contact with a contact member 45*a* of the locking-unlocking output lever 45. When the limiting lever 49 is held in the locking position, the limiting lever 49 extends obliquely downward to allow the stopper 49*a* not to contact the contact portion 45*a* of the output lever 45.

The locking-unlocking input member 44 is pivotally mounted on a transverse pivot shaft 51 in the casing 40 and forced clockwise by a spring 57 which is fixed at one end to the casing 40 and at the other end to the input member 44. The locking-unlocking input member 44 is held in a standby position in FIGS. 15 and 17 where a contact portion 44*b* at the lower front end contacts the casing 40.

On a circumferential groove 44*a* in the upper circumference of the locking-unlocking input member 44, the rear end of the Bowden cable 15 is wound by substantially ¼. To the lower end of the locking-unlocking input member 44, the lower end of the locking-unlocking output lever 45 is pivotally mounted with a transverse connecting shaft 52. A rear end 15*a* of the Bowden cable 15 wound on the circumferential groove 44*a* of the locking-unlocking input member 44 is fixed to an engagement hole 44*c* of the locking-unlocking input member 44. When the Bowden cable 15 moves forward on the basis of releasing action of the fully-closing output lever 13, the locking-unlocking input member 44 rotates against the force of the spring 57 around the pivot shaft 51 from the standby position in FIGS. 15 and 17 in a releasing direction or counterclockwise as shown in FIGS. 16 and 18.

The engagement hole 44*c* of the locking-unlocking input member 44 is corresponding to a locking-unlocking input portion to which the other end of the first action-transmitting member according to the present invention is coupled. The engagement hole 44*c* is variable in position and shape if required. Any structure of the locking-unlocking input portion is allowable if the motion of the first action-transmitting member can be inputted.

The locking-unlocking output lever 45 is pivotally mounted at the lower end to the lower end of the locking-unlocking input member 44 with the connecting shaft 52. To the upper end 45*b* of the locking-unlocking output lever 45, is coupled the front end of the Bowden cable 53 as the second action-transmitting member the rear end of which is coupled to a release lever (not shown) of the fully-closing rear door latch 2B. In the middle of the locking-unlocking output lever 45, a circular contact member 45*a* is pivotally mounted with a transverse shaft 54, around which there is provided a spring 55 fixed at one end to the locking-unlocking input member 44 and at the other end to the locking-unlocking output lever 45 to force the locking-unlocking output lever 45 with respect to the locking-unlocking input member 44 around the connecting shaft 52 clockwise.

The locking-unlocking output lever 45 is usually held in the standby position where the rear end of the upper end 45*b* contacts the front face of the stopper 40*a* of the casing 40.

The upper end of the locking-unlocking output lever 45 is corresponding to a locking-unlocking output portion connected to a fully-closing door latch according to the present invention. The locking-unlocking output portion is changeable in position and shape if required. The locking-unlocking output portion may be constructed so as to enable the first action-transmitting member to move by the locking-unlocking input portion.

Figure 15:
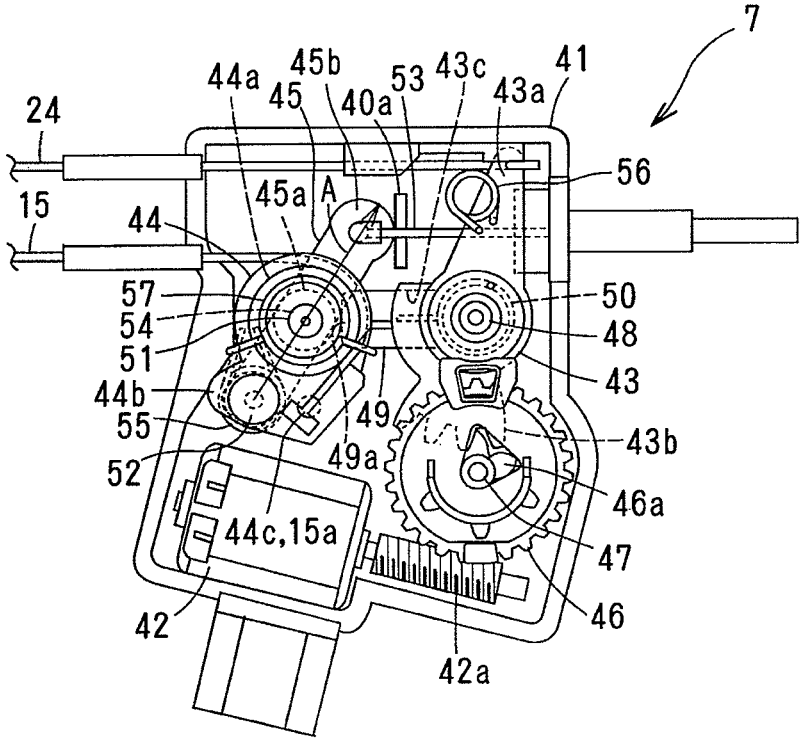
FIG. 15 is a rear view of a locking-unlocking unit in an unlocking state.
Figure 16:
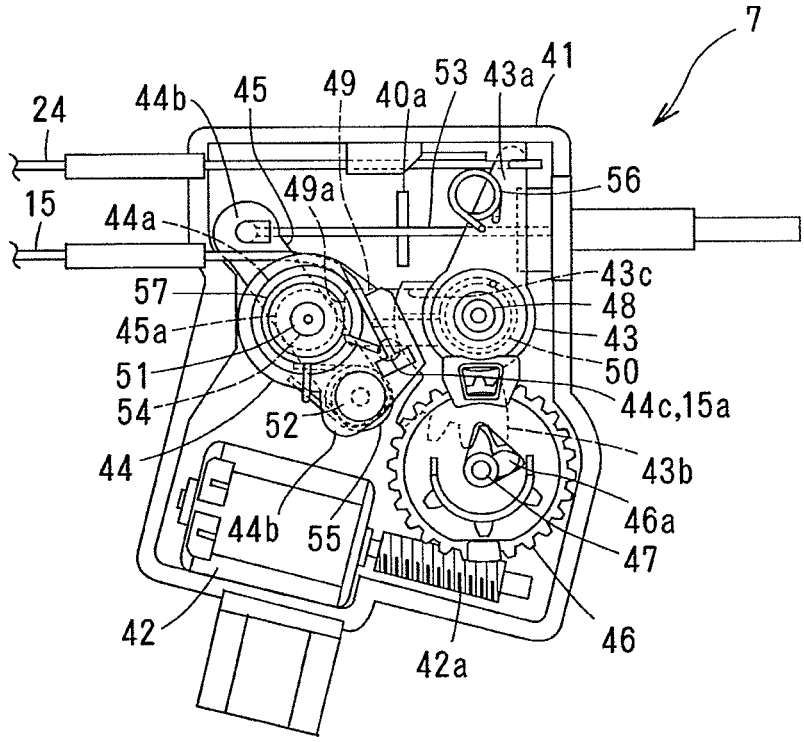
FIG. 16 is a view of the locking-unlocking unit in the unlocking state.

When the locking lever 43 is in the unlocking position and when the locking-unlocking input member 44 and the locking-unlocking output lever 45 are in the standby position in FIG. 15, an axis of the shaft 54 as the center of the contact member 45*a* is identical with an axis of the pivot shaft 51 as the center of the locking-unlocking input member 44, and the contact member 45*a* becomes capable of contacting a stopper portion 49*a* of the limiting lever 49. In this state, a longitudinal direction A of the locking-unlocking output lever 45 is directed at 60 degrees where the lower end of the locking-unlocking output lever 45 is in front of the upper end. When the locking-unlocking input member 44 rotates against force of the spring 57 in a releasing direction or counterclockwise in FIG. 15, the contact member 45*a* contacts the stopper portion 49*a* of the limiting lever 49 to prevent clockwise rotation around the connecting shaft 52 of the locking-unlocking output lever 45. Thus, the locking-unlocking output lever 45 rotates with the locking-unlocking input member 44 in a releasing direction from the standby position as shown in FIG. 16 while the outer circumference of the circular contact member 45*a* is in sliding contact with the stopper portion 49*a* of the limiting lever 49 around the pivot shaft 51 as virtual center. When the locking-unlocking output lever 45 rotates in the releasing direction, the releasing action of the locking-unlocking output lever 45 is transmitted to a release lever (not shown) of the fully-closing rear door latch 2B via the Bowden cable 53. The fully-closing rear door latch 2B disengages from the striker to allow the door 1 to open.

Figure 17:
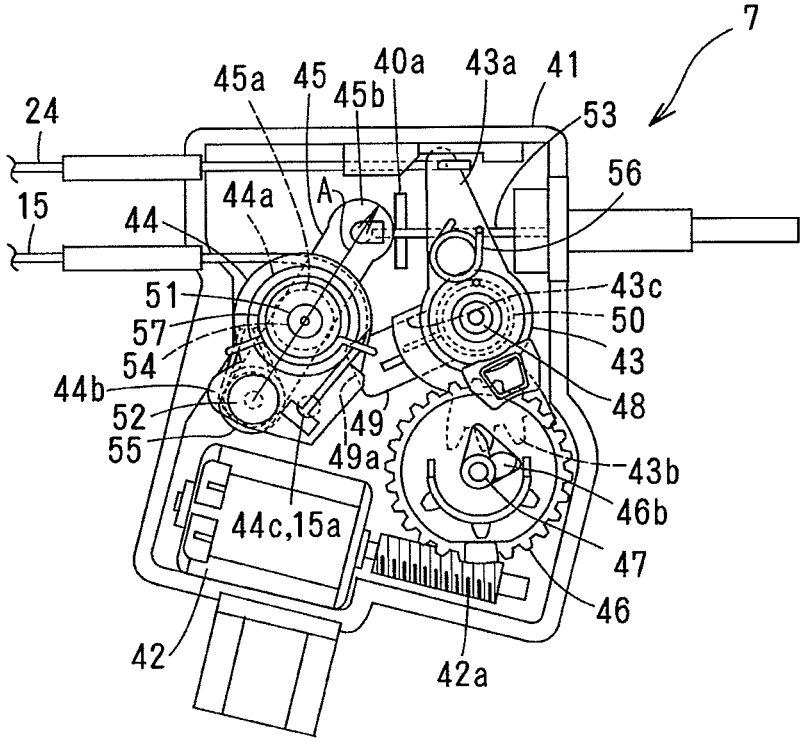
FIG. 17 is a view of the locking-unlocking unit in the locking state.
Figure 18:
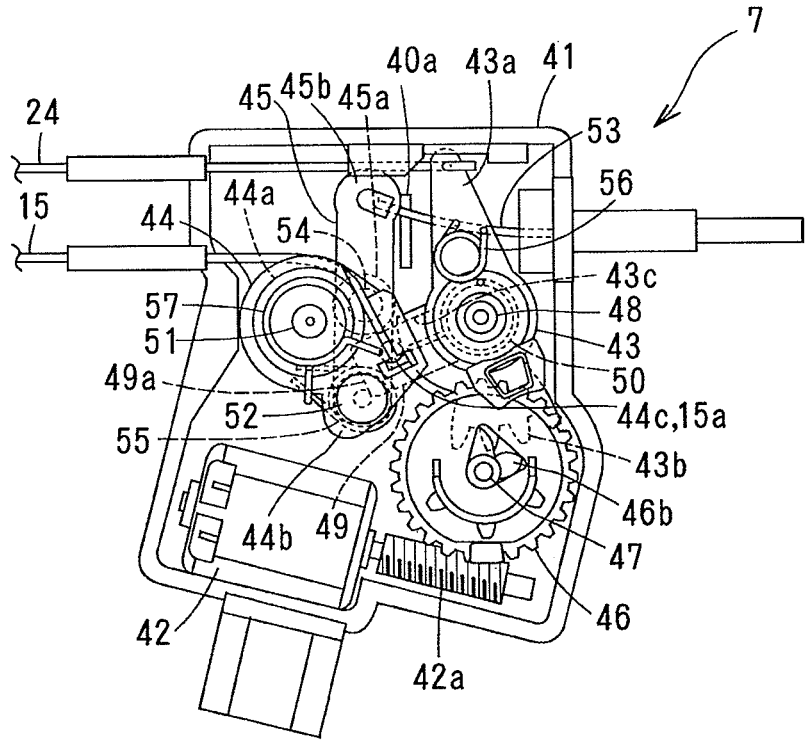
FIG. 18 is a view of the locking-unlocking unit in the locking state.

When the locking lever 43 is in the locking position and when the locking-unlocking input member 44 and the locking-unlocking output lever 45 are in the standby position in FIG. 17, an axis of the shaft 54 as center of the contact member 45*a* is consistent with the pivot shaft 51 as center of the locking-unlocking input member 44, and the contact member 45*a* leaves the stopper portion 49*a* of the limiting lever 49. In this state, as well as the locking lever 43 in the unlocking position, the longitudinal direction A of the output lever 45 is directed at about 60 degrees where the lower end of the output lever 45 is in front of the upper end. Even if the locking-unlocking input member 44 rotates in a releasing direction against the force of the spring 57, the contact member 45*a* does not contact the stopper portion 49*a* of the limiting lever 48 in FIG. 18. The locking output lever 45 becomes swinging/missing posture in FIGS. 18 and 19 where it swings about a contact portion of the rear end of the upper end 45*b* with the front face of the stopper 40*a*. Therefore, even if the locking-unlocking input member 44 rotates in the releasing direction from the standby position, the position of the upper end 45*b* coupled to the Bowden cable 53 of the locking-unlocking output lever moves slightly up and down, but does not shift longitudinally, so that the releasing action of the locking input lever 43 is not transmitted to the Bowden cable 53. When the locking lever 43 is in the locking position, the action of the outside handle 4 and opening action of the inside handle 5 are not transmitted to the fully-closing rear door latch 2B not to allow the door 1 to open.

When the locking-unlocking output lever 45 is in a swinging state, the contact member 45*a* of the locking-unlocking output lever 45 is positioned above the limiting lever 49 or within a rotation track of the limiting lever 49 and gets capable of contacting the upper edge of the limiting lever 49 when the limiting lever 49 moves from the locking position to the unlocking position.

One embodiment of this invention will be described.

When the Childproof Lever 18 of the Operational Unit 6 is in the Unlocking Position and when the Locking-Unlocking Unit 7 is in the Unlocking State in FIGS. 8 and 15

Figure 10:
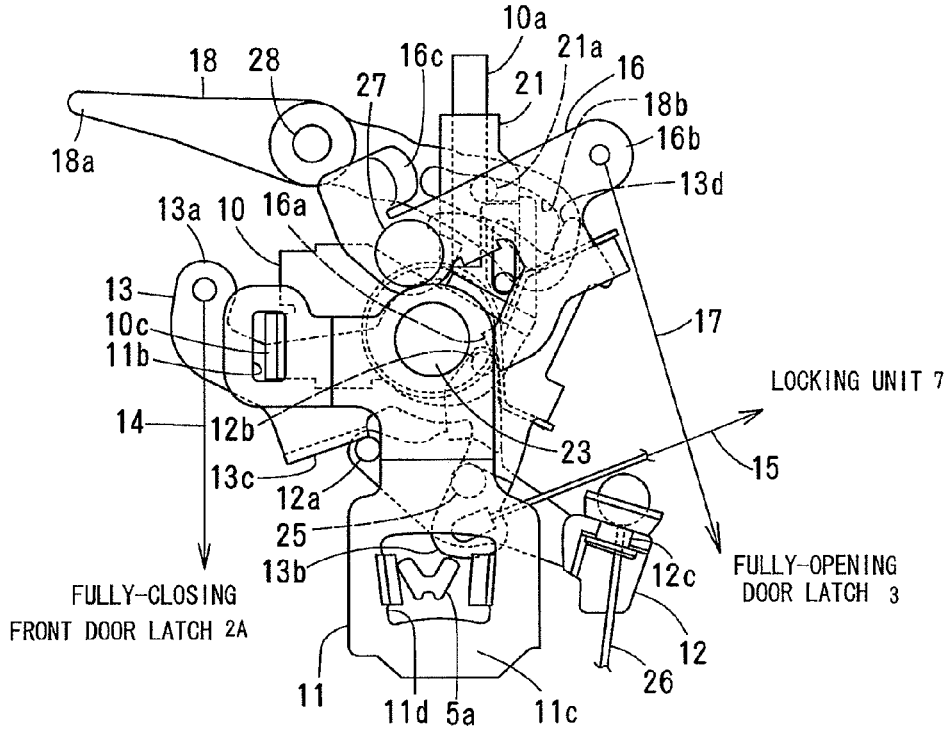
FIG. 10 is a view of the operational unit in which an outside handle is actuated when the childproof lever is in the unlocking position.
Figure 11:
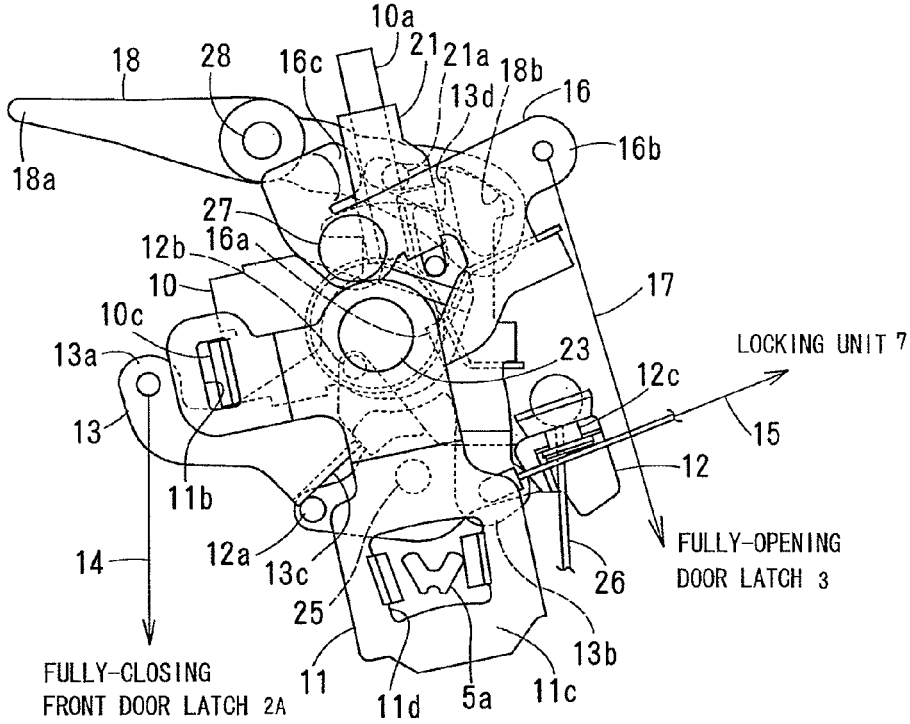
FIG. 11 is a view of the operational unit in which the inside handle is actuated to close the door.

When the outside handle 4 is operated while the door 1 is closed, the action of the outside handle 4 is transmitted to the outside input lever 12 via the Bowden cable 26. The outside input lever 12 rotates in a release direction or clockwise about the pivot shaft 25 from the standby position. In FIG. 10, the projection 12*a* contacts the contact portion 13*c* of the fully-closing output lever 13 to allow the fully-closing output lever 13 about the rotary shaft 20 from the standby position in the releasing direction or clockwise. The projection 12*b* contacts the contact portion 16*a* of the fully-opening output lever 16 to allow the fully-opening output lever 16 about the pivot shaft 27 from the standby position in a releasing direction or counterclockwise.

When the fully-closing output lever 13 rotates in the releasing direction, the releasing action of the fully-closing output lever 13 or outside handle 4 is transmitted to the release lever (not shown) of the fully-closing front door latch 2A via the Bowden cable 14 and to locking-unlocking input member 44 of the locking-unlocking unit 7 via the Bowden cable 15. In FIG. 15, the locking lever 43 and the limiting lever 49 of the locking-unlocking unit 7 are in the unlocking position, and the stopper portion 49*a* of the limiting lever 49 contacts the contact member 45*a* of the locking-unlocking output lever 45, so that the releasing action of the fully-closing output lever 13 is transmitted to the locking-unlocking input member 44 via the Bowden cable 15, and the locking-unlocking input member 44 rotates about the pivot shaft 561 in the releasing direction or counterclockwise from the standby position in FIG. 15. Thus, in FIG. 16, the locking-unlocking output lever 45 operates about the pivot shaft 51 as virtual center from the standby position to the release position. And the releasing action of the locking-unlocking output lever 45 is transmitted to the release lever of the fully-closing rear door latch via the Bowden cable 53.

The outside handle 4 is operated when the door 1 is closed, and the action of the outside handle 4 is fed into the outside input lever 12 by the operational unit 6 and transmitted to the fully-closing output lever 13. The action by the outside handle outputted from the fully-closing output lever 13 is transmitted to the fully-closing front door latch 2A via the Bowden cable 14, and to the fully-closing rear door latch 2B via the locking-unlocking unit 7 and the Bowden cable 53 respectively, so that the fully-closing front door latch 2A and the fully-closing rear door latch 2B are released to allow the door to open from outside the vehicle.

Figure 9:
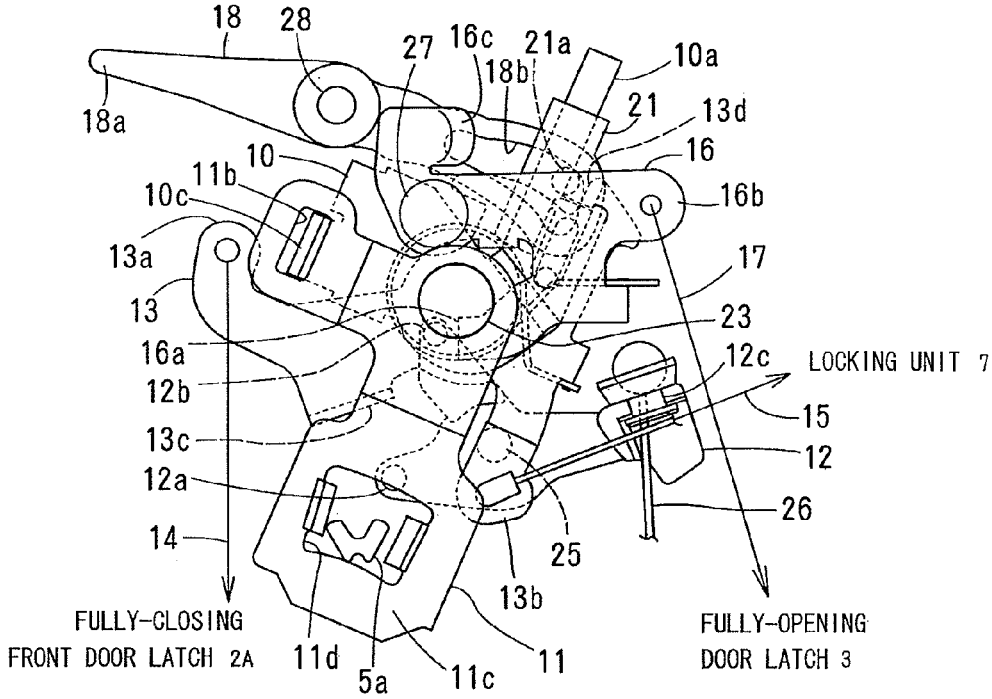
FIG. 9 is a view of the operational unit in which an inside handle is actuated to open a door, when the childproof lever is in the unlocking position.

The inside handle 5 is operated to open the door 1 when the door 1 is closed, and the action of the inside handle 5 is transmitted to the second inside input lever 11 via the arm 5*a*. The first inside input lever 10 and the second inside input lever 11 rotates about the pivot shaft 23 and the rotary shaft 20 respectively in a releasing direction or clockwise from the standby position in FIGS. 5 and 8. As shown in FIG. 9, the projecting shaft 21*a* of the slider 21 which rotates with the first inside input lever 11 contacts the engagement step 13*d* of the fully-closing output lever 13 to allow the fully-closing output lever 13 to turn about the rotary shaft 20 in the releasing direction or clockwise from the standby position.

When the fully-closing output lever 13 rotates in the releasing direction, as well as the action by the outside handle 4 as above, the releasing action of the fully-closing output lever 13 is transmitted to the release lever (not shown) of the fully-closing front door latch 2A via the Bowden cable 14 and to the release lever of the fully-closing rear door latch 2B via the locking-unlocking unit 7 and the Bowden cable 53.

The inside handle 5 is operated to open the door 1 when the door 1 is closed, and the opening action of the inside handle 5 is fed to the first and second inside input levers 10,11 by the operational unit 6 and transmitted to the fully-closing output lever 13. And as well as the outside handle 4 as above, the opening action of the inside handle 5 is transmitted to the fully-closing front door latch 2A via the Bowden cable 14 and to the fully-closing rear door latch 2B via the locking-unlocking unit 7 and the Bowden cable 53. Thus, by the opening action of the inside handle 5, the fully-closing front door latch 2A and the fully-closing rear door latch 2B are released to allow the door 1 to open from inside the vehicle.

The outside handle 4 is actuated when the door 1 is fully open, and the projection 12*b* of the outside input lever 12 contacts the contact portion 16*a* of the fully-opening output lever 16 on the basis of releasing action of the outside input lever 12 to make releasing action of the fully-opening output lever 16. Thus, the releasing action is transmitted to the fully-opening door latch 3 via the Bowden cable 17 to disengage the fully-opening door latch 3 from the striker to allow the door 1 to close.

Figure 5:
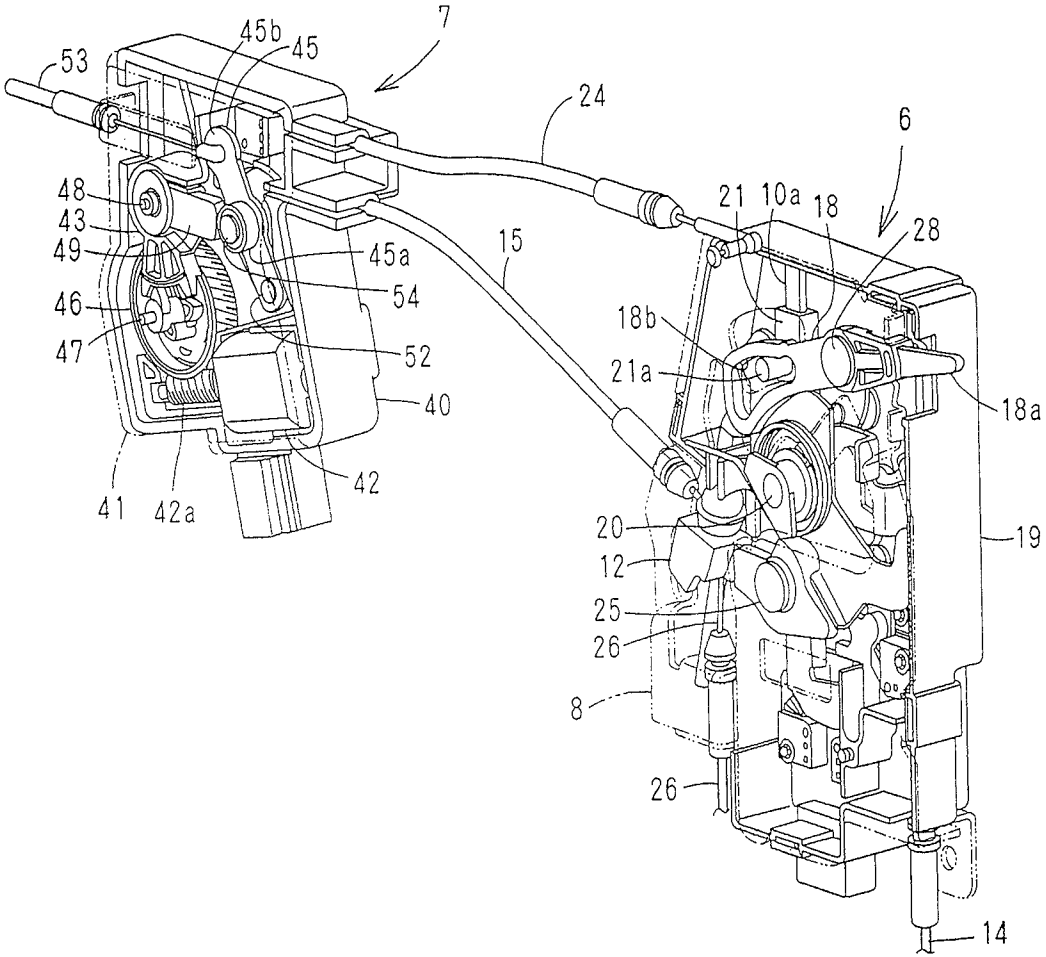
FIG. 5 is a perspective view of the internal structure seen from inside the vehicle.

When the Childproof Lever 18 of the Operational Unit 6 is in the Unlocking Position and when the Locking-Unlocking Unit 7 is in the Locking State When the outside handle 4 is operated in FIGS. 5, 8 and 17, the action by the outside handle 4 is transmitted to the release lever (not shown) of the fully-closing front door latch 2A via the Bowden cable 14 and to the locking-unlocking input member 44 of the locking-unlocking unit 7 via the Bowden cable 15. The opening action with the inside handle 5 is transmitted to the fully-opening front door latch 2A and the locking-unlocking input member 44 of the locking-unlocking unit 7. However, in FIG. 17, the locking lever 43 and the limiting lever 49 of the locking-unlocking unit 7 is in the locking position, and the stopper portion 49*a* of the limiting lever 49 does not contact the contact member 45*a* of the output lever 45. The releasing action with the fully-closing output lever 13 is transmitted to the locking-unlocking input member 44 via the Bowden cable 15. Even if the locking-unlocking input member 44 rotates about the pivot shaft 51 in the releasing direction or counterclockwise from the standby position in FIG. 17, the action of the outside handle 4 fed to the locking-unlocking input member 44 and opening action of the inside handle 5 is not transmitted from the locking-unlocking output lever 45 to the fully-closing rear door latch 2B because the locking-unlocking output lever 45 swings about a contacting point with the stopper 40*a*.

When the locking-unlocking unit 7 is in the locking state, the action by the outside handle 4 or the inside handle 5 is transmitted to the locking-unlocking unit 7 via the Bowden cable 15, but the action by the outside handle 4 or the inside handle 5 is not sent from the locking-unlocking unit 7. Thus, even if the outside handle 4 or the inside handle 5 is actuated, the fully-closing rear door latch 2B cannot be released, so that the door 1 cannot be opened from inside or outside the vehicle.

Figure 19:
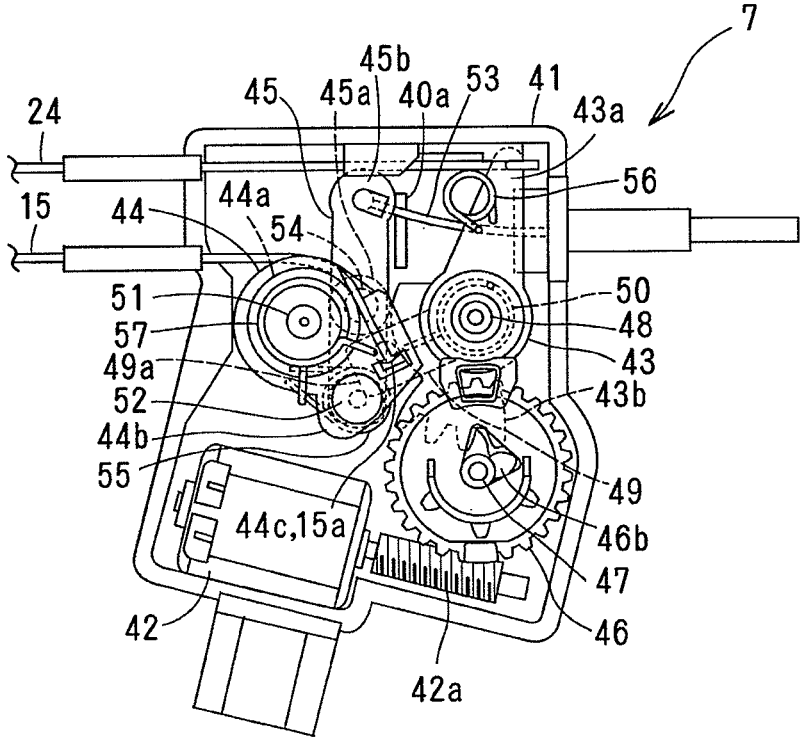
FIG. 19 is a view of the locking-unlocking unit involved in panic.

When the locking-unlocking unit 7 is in the locking state, a switch or a locking knob 22 is actuated for unlocking right after or as soon as the outside handle 4 or the inside handle 5 is operated. In FIG. 19, the upper edge of the limiting lever 49 contacts the under side of the contact member 45*a* of the swinging output lever 45, so that panic occurs in which the limiting lever 49 is prevented from moving to the unlocking position. However, in this embodiment, even if the limiting lever 49 is bound in the locking position, the locking lever 43 can turn against a force of the spring 50 from the locking position to the unlocking position. By cancelling the action of the outside handle 4 or the inside handle 5, the locking-unlocking input member 44 is returned to the standby position, and the contact member 45*a* of the locking-unlocking output lever 45 goes out of a track of the limiting lever 49 to allow the limiting lever 49 to move to the unlocking position by a force of the spring 50 or to an unlocking state in FIG. 15.

When the Childproof Lever 18 of the Operational Unit 6 is in the Locking Position and when the Locking-Unlocking Unit 7 is in the Unlocking State When the outside handle 4 is actuated, the fully-closing output lever 13 and the fully-opening output lever 16 rotate in the releasing direction on the basis of the releasing action of the outside input lever 12 regardless of the position of the childproof lever 18. As the childproof lever 18 is in the unlocking position, the fully-closing front door latch 2A and the fully-closing rear door latch 2B are actuated to allow the door 1 to open.

When the inside handle 5 is actuated to open the door 1, the slider 21 is in the locking position, and the projecting shaft 21*a* of the slider 21 is in a position where it cannot engage with the engagement step 13*d* of the fully-closing output lever 13. Even if the first and second inside input levers 10,11 rotate in an open-releasing direction, the rotation is not transmitted to the fully-closing output lever 13. Thus, even if the inside handle 5 is actuated to open the door 1, the door 1 cannot be opened.

When the childproof lever 18 of the operational unit 6 is in the Locking Position and when the Locking-Unlocking Unit 7 is in the Unlocking Position The outside handle 4 is actuated when the door 1 is closed, and the fully-closing output lever 13 and the fully-opening output lever 16 rotate in the releasing direction on the basis of the releasing action of the outside input lever 12 regardless of the position of the childproof lever 18, so that the action of the outside handle 4 is transmitted to the locking-unlocking input member 44 of the locking-unlocking unit 7 via the Bowden cable 15, but the locking lever 43 and the limiting lever 49 of the operational unit 7 are in the locking position, so that the action is not outputted from the locking-unlocking output lever 45. The door cannot be opened.

The inside handle 5 is actuated to open the door when the door 1 is closed, and the opening action of the inside handle 5 is not outputted from the fully-closing output lever 13 of the operational unit 6, so that the door 1 cannot be opened.

The outside handle 4 is actuated when the door 1 is in the fully-open position, and the projection 12*b* contacts the contact portion 16*a* of the fully-opening output lever 16 on the basis of releasing action of the outside input lever 12 even when the childproof lever 18 is in the locking position, and the fully-opening output lever 18 is actuated for releasing, which is transmitted to the fully-opening door latch 3 via the Bowden cable 17, so that the fully-opening door latch 3 disengages from the striker to allow the door 1 to close.

The inside handle 5 is actuated to close the door 1 when the door 1 is fully open, and the fully-opening output lever 16 is actuated for releasing because the upward arm 10*a* of the first input lever 10 contacts the contact portion 16*c* of the fully-opening output lever 16 via the slider 21 on the basis of rotation of the first and second inside input levers 10,11 in a releasing direction for closing the door. And the releasing action is transmitted to the fully-opening door latch 3 via the Bowden cable 17, so that the fully-opening door latch 3 disengages from the striker to allow the door 1 to close.

One embodiment of this invention is described and various modifications and changes as below may be made without departing from the scope of claims:

(i) The Bowden cables 14, 15, 17, 24, 26, 53 as action-transmitting member may be replaced with a rod.

(ii) The locking-unlocking unit 7 may be disposed under or below the operational unit 6 obliquely downward.

(iii) Another locking-unlocking means may be used in the locking-unlocking unit 7. For example, the locking lever 43 is integrally formed with the limiting lever 49. When the locking lever 43 is in the unlocking position, the releasing action of the locking-unlocking input member 44 can be transmitted to the locking-unlocking output lever 44. Meanwhile, when the locking lever 43 is in the locking position, the releasing action of the locking-unlocking input member 44 cannot be transmitted to the locking-unlocking output lever 44. When the locking lever 43 is in the unlocking position, the locking-unlocking input member 44 is connected to the locking-unlocking output lever 45. When the locking lever 43 is in the locking position, a movable pin may be provided to cut the relationship between the locking-unlocking input member 44 and the locking-unlocking output lever 45.

(iv) The Bowden cable 14 coupled to the fully-closing front door latch 2A may be coupled to the locking-unlocking output lever 45 with the Bowden cable 53 coupled to the fully-closing rear door latch 2B.

What is claimed is:

1. A device for operating a door latch in a vehicle, comprising:

an inside handle provided on a door inside a vehicle and having an arm;

an outside handle provided on the door outside the vehicle;

a fully-closing door latch provided on the door to engage with a striker of a vehicle body to hold the door closed;

an operational unit provided in the door, the operational unit comprising a first base member fixed to the door, an inside input lever having an engagement hole at a lower part and coupled to the inside handle by engaging the arm of the inside handle in the engagement hole of the inside input lever, an outside input lever connected to the outside handle, and a fully-closing output lever pivotally mounted to the first base member to rotate with the inside input lever and the outside input lever and enabling an action of the inside handle or the outside handle to be tapped off;

a first action-transmitting member comprising a Bowden cable and coupled to the fully-closing output lever of the operational unit at one end to move with releasing action of the operational unit;

a second action-transmitting member comprising a Bowden cable and coupled to the fully-closing door latch;

a locking-unlocking unit spaced from the operational unit in the door, the locking-unlocking unit comprising a second base member fixed to the door, a locking-input member pivotally mounted to the second base member and coupled to the first action-transmitting member, a locking-unlocking output lever coupled to the fully-closing door latch via the second action-transmitting member, a locking-unlocking lever pivotally mounted to the second base member and moving between the unlocking position where rotation of the locking-unlocking-input member is capable of being transmitted to the locking-unlocking output lever and a locking position where the rotation is not capable of being transmitted, and an electric actuator that moves the locking-unlocking lever to the unlocking position and the locking position, the locking-unlocking unit being connected to the operational unit via the first action-transmitting member and to the fully-closing door latch via the second action-transmitting member, the locking-unlocking unit being capable of being switched between an unlocking state in which an action with the inside handle or the outside handle is transmitted to the fully-closing door latch via the second action-transmitting member and a locking state in which the action is not transmitted, wherein the fully-closing door latch, the operational unit and the locking-unlocking unit are separated from each other; and another action-transmitting member that comprises a Bowden cable and connects the operational unit to the locking-unlocking unit to transmit locking/unlocking action from the operational unit to the locking-unlocking unit.

2. The device of claim 1 wherein the electric actuator comprises an electric motor.

3. The device of claim 1 wherein the operational unit comprises another output portion connected to a fully-opening door latch keeping the door fully open via a third action-transmitting member moving along a panel surface of the door.

4. The device of claim 3 wherein the third action-transmitting member comprises a Bowden cable.

5. The device of claim 3 wherein the operational unit further comprises a fully-opening output lever pivotally mounted to the first base member and coupled to the third action-transmitting member to move with the inside input lever and the outside input lever.

6. The device of claim 1 wherein the outside input lever is connected to the outside handle via a fourth action-transmitting member comprising a Bowden cable.

7. The device of claim 5 wherein the operational unit further comprises a childproof lever pivotally mounted to the first base member to allow an action of the inside input lever to be transmitted to the fully-closing output lever.

8. The device of claim 1 wherein the door comprises a sliding door.

* * * * *